US006082661A

United States Patent [19]

Focke et al.

[11] Patent Number: 6,082,661

[45] Date of Patent: Jul. 4, 2000

[54] METHOD AND DEVICE FOR HANDLING ADHESIVE WEBS

[75] Inventors: Heinz Focke, Verden; Hugo Mutschall, Kirchlinteln, both of Germany

[73] Assignee: Focke & Co. (GmbH & Co.), Verden, Germany

[21] Appl. No.: 09/118,504

[22] Filed: Jul. 17, 1998

[51] Int. Cl.[7] ..... B65H 19/18; B65H 19/10

[52] U.S. Cl. ..... 242/556.1; 242/554.3; 242/555.5

[58] Field of Search ..... 242/556, 556.1, 242/554.3, 555.1, 555.3, 555.5, 566

[56] References Cited

U.S. PATENT DOCUMENTS

| | | | |
|---|---|---|---|
| 2,940,506 | 6/1960 | McKee et al. | 242/556 X |
| 3,201,057 | 8/1965 | Ryan | 242/554.3 X |
| 3,880,699 | 4/1975 | Nishimoto | 156/505 |
| 4,039,367 | 8/1977 | Warshaw et al. | 156/486 |
| 4,264,401 | 4/1981 | Ganz | 242/556.1 X |
| 4,564,149 | 1/1986 | Barzano' | 242/554.1 |
| 4,652,329 | 3/1987 | Focke | 242/555.1 X |
| 4,770,359 | 9/1988 | Kiuchi | 242/556.1 X |
| 5,131,593 | 7/1992 | Siegfried et al. | 242/555.1 X |
| 5,190,612 | 3/1993 | Orlandi | 156/567 |
| 5,308,007 | 5/1994 | Stroszynski | 242/555.4 |
| 5,411,223 | 5/1995 | Gatteschi | 242/556 X |

FOREIGN PATENT DOCUMENTS

| | | |
|---|---|---|
| 2117528 | 7/1972 | France . |
| 2733972 | 11/1996 | France . |
| AS1057912 | 5/1959 | Germany . |
| 4205343A1 | 8/1992 | Germany . |
| 19503398A1 | 8/1995 | Germany . |
| 19704679A1 | 8/1997 | Germany . |
| WO94 27869 | 12/1994 | WIPO . |
| WO96 11867 | 4/1996 | WIPO . |

*Primary Examiner*—Donald P. Walsh
*Assistant Examiner*—William A. Rivera
*Attorney, Agent, or Firm*—Abelman, Frayne & Schwab

[57] ABSTRACT

Method and device for handling material webs coated on one side with an adhesive (15). The material web (14) coated on one side with adhesive (15) is drawn from an (active) reel (16). A replacement reel (18) is prepared (manually) for connecting an initial section (19) to the material web which is running out. Once the material web (14) from the reel (16) has been used up, the initial section (19) of the replacement reel (18) is pressed against the adhesive (15) side of the outgoing material web (14) and thus connected to the material web (14).

11 Claims, 5 Drawing Sheets

METHOD AND DEVICE FOR HANDLING ADHESIVE WEBS

Figure 1:
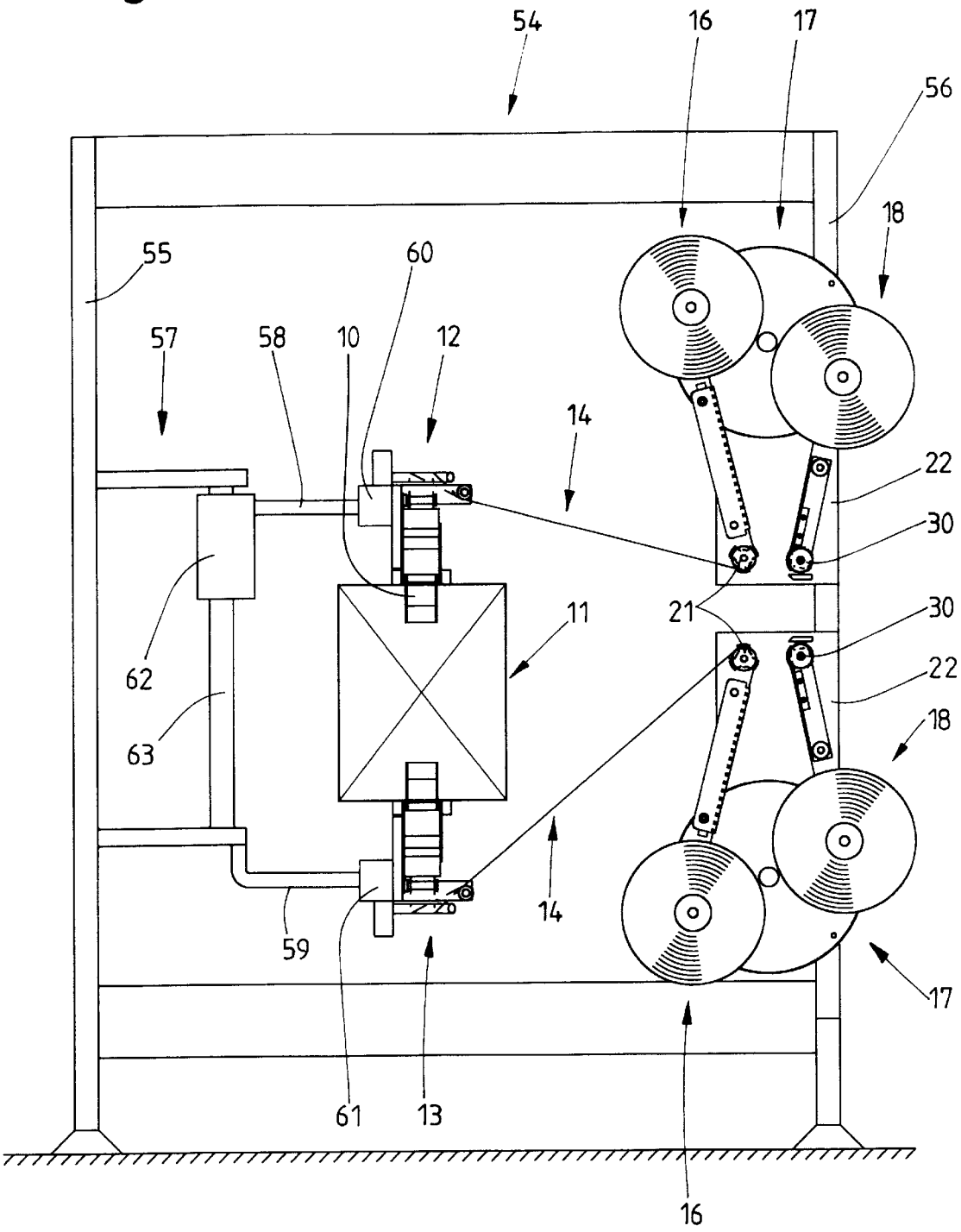

The invention relates to a method and device for handling material webs coated with adhesive on one side, especially for applying sections of an adhesive tape to folded cardboard boxes, the material web or the adhesive tape being drawn from a first reel and, once this has been used up, a new material web/a new adhesive tape being connected to the material web which is running out.

Material webs, coated on one side with additive adhesive, or adhesive tapes are used, for example, to close folded cardboard boxes. A so-called tape assembly applies the adhesive tape, for example, on the upper side and on the lower side in the region of abutting closing flaps on the folded cardboard box. The adhesive tape consists of a plastic web with active adhesive applied to one side of it.

The material web or the adhesive tape is made available as a (coiled) reel. When it has been used up, a new material web or a new adhesive tape has to be connected to the one which is running out, with as little outlay as possible.

Accordingly, the object underlying the invention is to propose a method and a device which are suitable for ensuring simple, reliable handling of adhesive tapes, especially in joining a new adhesive tape to one which is running out.

In fulfillment of this object, the method according to the invention is characterized in that the new adhesive tape or the new web with a free initial section to connect it to the outgoing web is pressed with its adhesive side against the facing, adhesive side of the outgoing web.

The initial section of the new web is held in readiness by a holding device which may be actuated—by machine or by hand—against which the initial section of the adhesive side lies. The contact region of the holding device is so configured that the retaining force for the initial section is sufficient to fix same until it is in contact with the outgoing web. Through contact with the adhesive side of the outgoing web, greater retaining force is generated which fixes the initial section to the outgoing web as a result of glueing such that the holding device can be detached from the initial section of the new web.

The holding device for the initial section of the new web is a movable, especially swivelling, arm which, through a transverse movement, presses the initial section against the outgoing web in the region of a deflection of same, especially in the region of a reflection roller.

A further special characteristic of the invention consists in the fact that the active reel, from which the material web is drawn, is run until it is completely used up. Thus no remaining section of the material web is left on the reel or on at reel core. In the invention, special measures are provided which ensure that, even after the end section of the material web has been drawn from the reel or the reel core, a certain tension is preserved in the material web, such that said web can be transported without faults, the formation of creases or the like, until a new material web is connected. To this end, according to the invention, a cross-sectional deformation of the material web which is running out is provided.

In the region of a splicing station, there are disposed on a common swivellable carrier, especially on a carrying disc, two reels of the adhesive tape, namely a supply reel and a replacement reel from which the new web is drawn. Through the rotation of the carrying disc, the supply reel is respectively moved into a predetermined run-out position and the replacement reel into a waiting position. The initial section of the new web is preferably drawn manually from the replacement reel and laid on the holding device.

Further details of the invention relate to the design of the splicing station and to members for transferring adhesive tape to objects.

Figure 2:
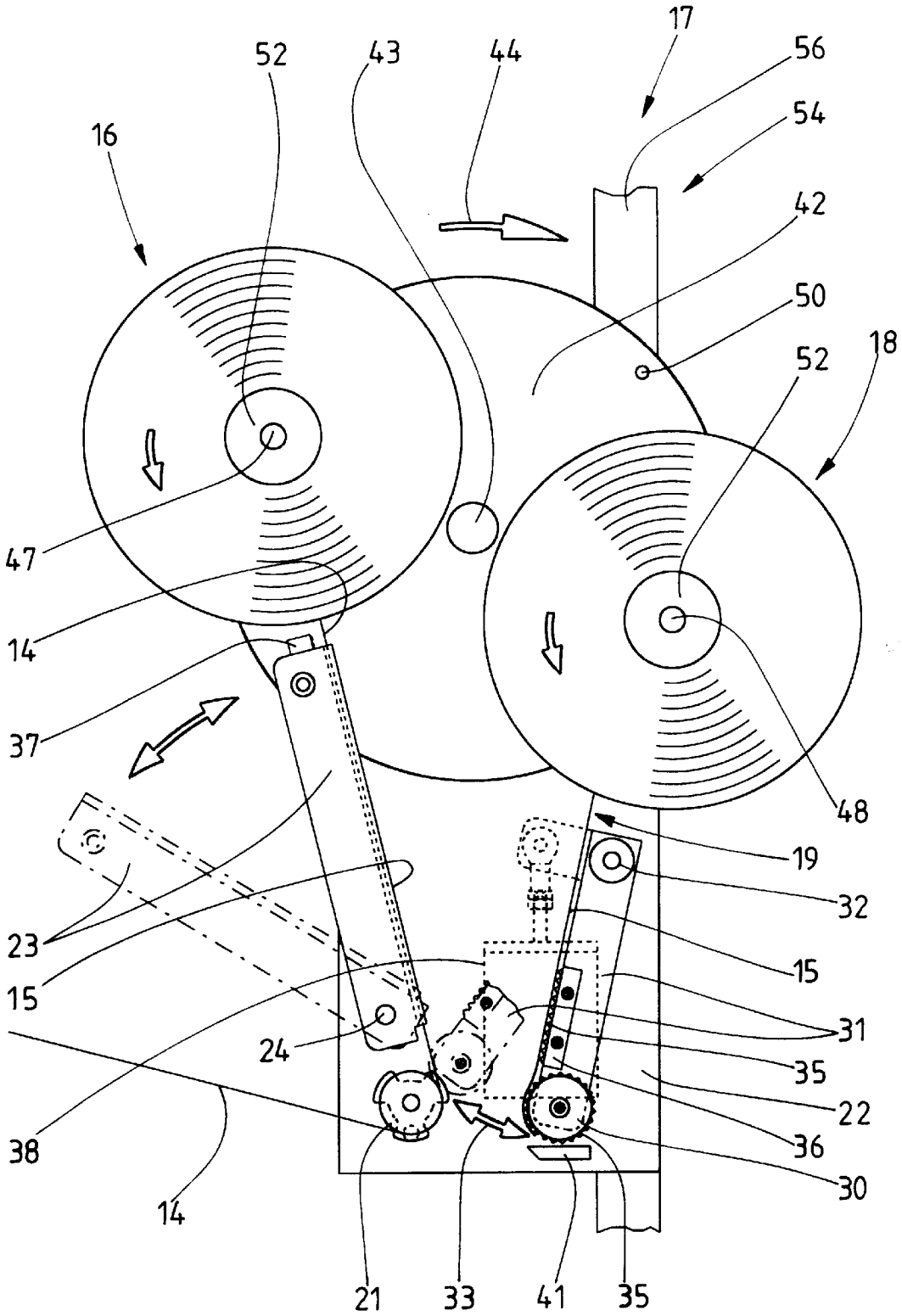
Figure 3:
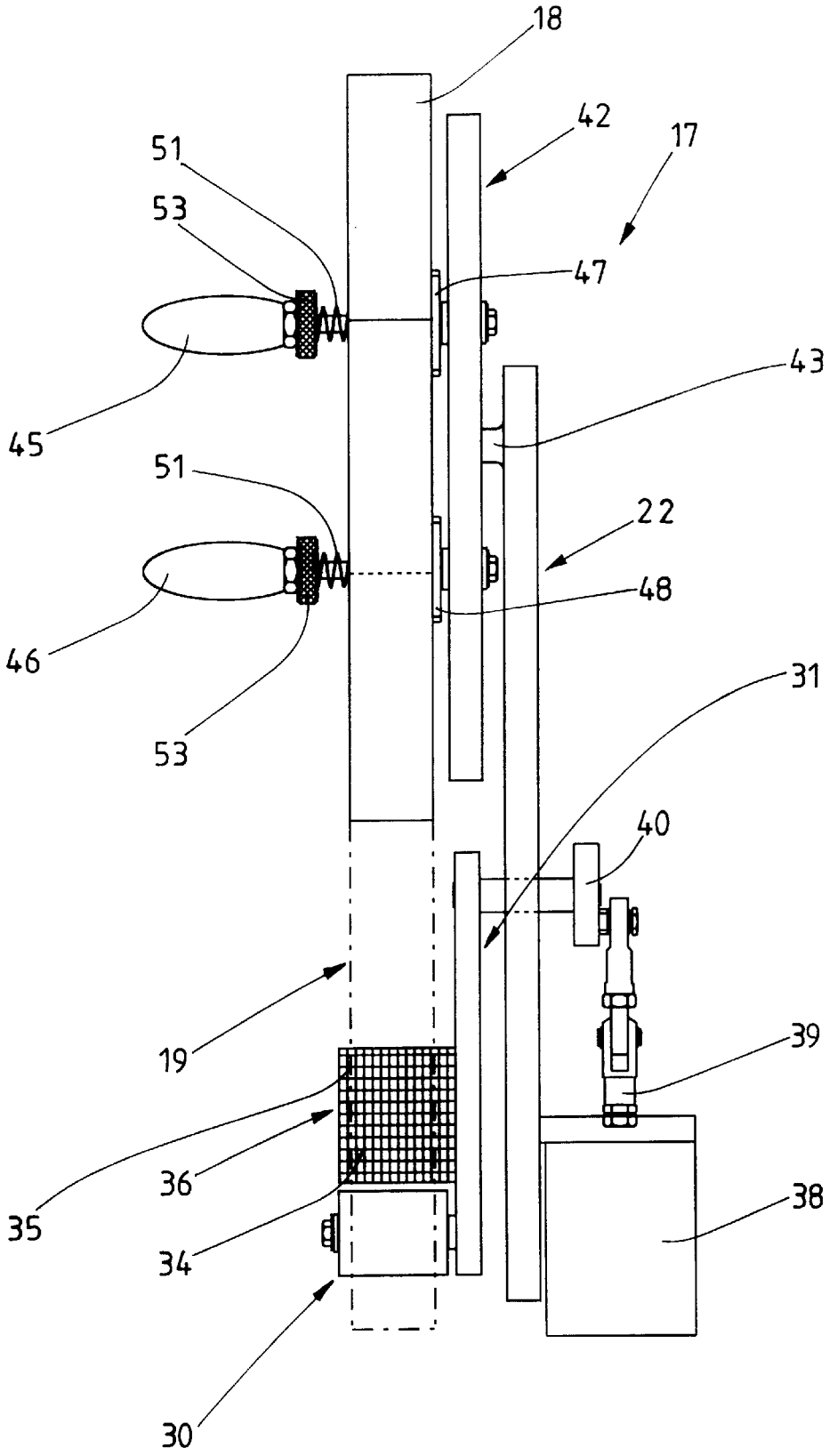
Figure 4:
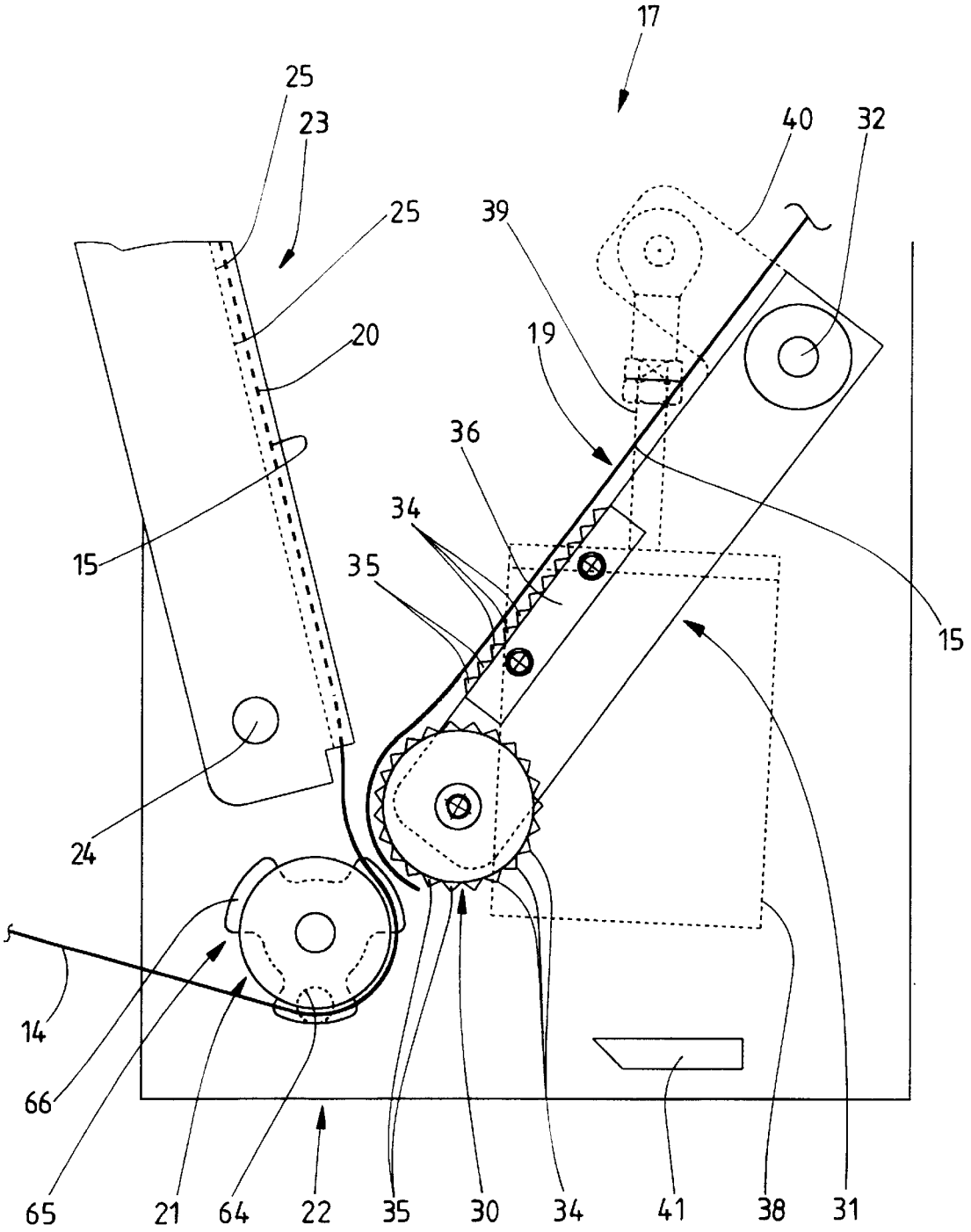
Figure 5:
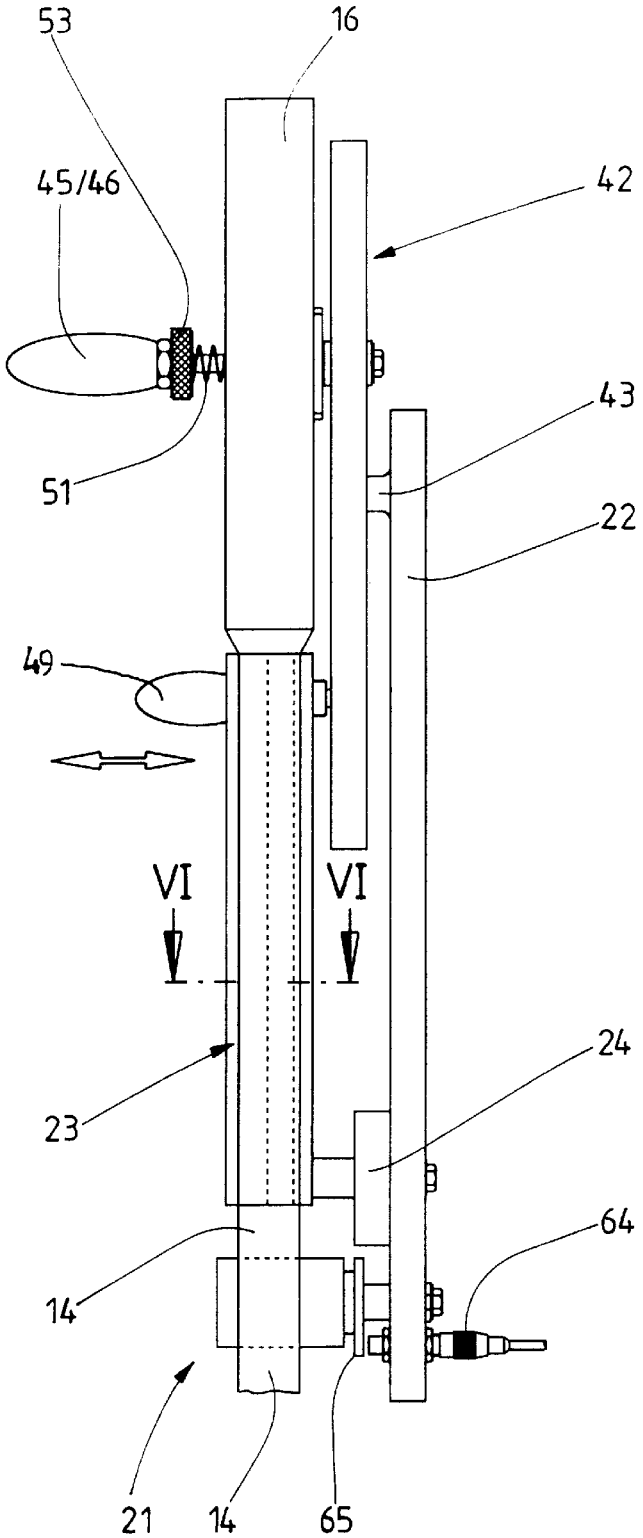
Figure 6:
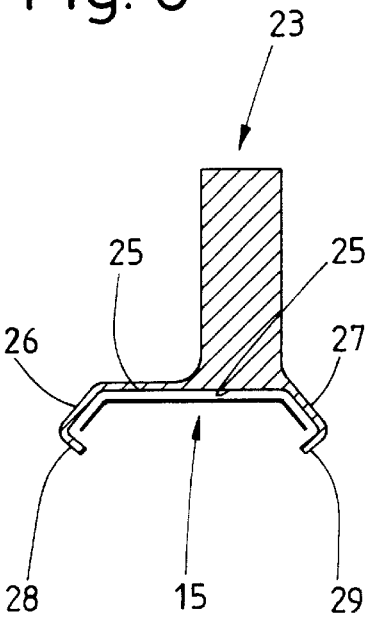

An exemplary embodiment of the device according to the invention is explained in greater detail below with respect to its construction and the process run, with the aid of the drawings. These show:

FIG. 1 a device for applying adhesive tape to folded cardboard boxes, in simplified side view, FIG. 2 a splicing station as a detail of the device according to FIG. 1, on an enlarged scale, FIG. 3 the splicing station according to FIG. 2, in transverse view, FIG. 4 a detail of the splicing station, on an enlarged scale, FIG. 5 a transverse view of the splicing station in a plane offset to FIG. 3, FIG. 6 a retaining shoe of the splicing station in an enlarged cross-section, in the cutting plane VI—VI of FIG. 5.

The device shown in FIG. 1 is concerned with the application of an adhesive tape 10 to a folded cardboard box 11. Applied respectively to an upper side and a lower side of the folded cardboard box 11 is an adhesive tape 10 a running in the longitudinal direction of same, in order to connect folding tabs to one another.

For applying the adhesive tape 10 there are respectively an upper and a lower tape assembly 12, 13 which automatically apply an adhesive tape 10 to the folded cardboard box 11.

The adhesive tape 10 is separated from a continuous strip or a continuous material web 14. The latter consists preferably of plastic and is coated on one side with an active adhesive 15. The material web 14 is drawn from the reel 16 and led to the tape assembly 12, 13. The reel 16 is located in the splicing station 17 together with a replacement reel 18. On the present embodiment, the device is equipped with two matching splicing stations 17, in order to supply each tape assembly 12, 13 with material automatically.

Once the active reel 16 has been used up, the replacement reel 18 is connected largely automatically to the outgoing material web 14 in the region of the splicing station 17. On the present example, however, certain manual intervention is proficed for changing the reels.

The replacement reel 18 is prepared for the exchange while the material web 14 is being drawn from the (active) reel. To this end, an initial section 19 is drawn (manually) from the replacement reel 18 and held in readiness adjacent to the material web 14. When the material web 14 has been drawn either partially or completely from the reel 16, the initial section 19 of the replacement reel 18 is pressed against an end section 20 of the material web 14 which is running out, and thus the material web 14 is connected to the replacement reel 18.

In order to carry out the exchange of webs, the splicing station 17 is provided with members which work automatically. The (continuous) material web 14 is led, at the exit of the splicing station 17, over a deflection member, namely over a deflection roller 21. The material web 14 is coiled on the reel 16 in such a way that the adhesive 15 applied to one side of the material web faces outwards in the region of the deflection roller 21.

The deflection roller 21 is mounted at a spacing from the reel 16, on an (upright) carrying wall 22. The material web 14 is drawn from the reel 16 is led over a leading or guiding member of the deflection roller 21, namely over a shoe 23. The latter is configured as an elongated one-armed lever with a (lower) pivot bearing 24 adjacent to the deflection roller 21 and above same.

The shoe 23 is provided with a guide surface 25 for the material web 14. The shoe 23—seen in cross-section—is configured as an elongated hollow body with a corresponding cross-sectional contour of the guide surface 25. As can be seen in particular from FIG. 6, the shoe 23 is configured approximately C-shaped in cross-section, i.e. as a profile open at one side. The guide surface 25 forms sloping side strips 26, 27 at the edges. The latter pass into guide limbs 28, 29, offset again by 90°, at their free outer edges.

The material web 14 runs constantly past the guide surface 25 contoured in the manner described and thus receives a corresponding, shaped cross-sectional form. By this means, the material web 14 is prevented from being deformed in its longitudinal direction, in particular from becoming creased. In addition, because of the design of the guide surface 25, the shoe 23 exercises a retaining force on the transported material web 14. It is thus possible with this device to run the respective reel 16 until it is completely empty, i.e. without separating off a remaining portion of the material web 14 which stays on the reel 16. This feature and the design of the shoe 23 are special characteristics of the device.

In order to change the reels, the shoe 23 is moved, by being swivelled out of the movement plane of the material web 14, into a position which is shown in a dot-dash line in FIG. 2. When the shoe 23 is brought back again into the position in which the material web 14 is adjacent to the guide surface 25, the replacement reel 18 or its initial section 19 is held adjacent to the deflection roller 21 ready to be connected to the material web 14. The initial section 19 is adjacent to a transfer member, namely a transfer roller 30, which is mounted for its part on the lower or free end of a one-armed transfer lever 31. The latter may be swivelled in the region of a pivot bearing 32 disposed adjacent to the replacement reel 18. This pivot bearing is also disposed on the common carrying wall 22. The relative position is chosen to be such that, with a swivel movement as per arrow 33, the transfer roller 30 is swivelled out of its initial position as per FIG. 2 into the transfer position as per FIG. 4. In the latter, the transfer roller 30 is directly adjacent to the perimeter of the deflection roller 21, and in such a way that a free end of the initial section 19 is pressed against the material web 14 in the region of the deflection roller 21.

The replacement reel 18 is positioned in such a way that the initial section 19 with the adhesive 15 faces the transfer roller 30 or the transfer lever 31. Accordingly, the initial section 19 lies with an adhesive surface against the perimeter of the transfer roller 30 and—on the present embodiment—against the transfer lever 31.

Transfer roller 30 and/or transfer lever 31 are so designed that, on the one hand the material web with its adjacent adhesive side is held sufficiently, but on the other hand, when pressed on a side of the material web which is provided with adhesive 15, said web grasps the end of the initial section 19 and draws it from the transfer roller 30 or transfer lever 31. For this purpose, the transfer roller 30 is provided along its perimeter with projections or raised parts. In the present case, these are projecting points 34 which are here formed by pyramid-shaped raised parts 35. The raised parts 35, and thus the points 34 of same, are in the present case disposed in longitudinal and transverse rows, evenly distributed along the perimeter of the transfer roller 30.

A holding piece 36 for the material web 14 or the initial section 19 is formed in the region of the transfer lever 31, adjacent to the transfer roller 30. The initial section 19 is likewise adjacent to said holding piece. The holding piece 36 is provided with raised parts 35 and points 34 in the same way as the transfer roller 30.

When the new material web or the initial section 19 is transferred to the material web 14 which is running out, a end region of the initial section 19 is pressed with its non-adhesive side to the adhesive side of the material web 14, and thus a sufficiently durable connection is made. The material web 14 is thereafter drawn from the replacement reel 18 which assumes the function of the active reel 16.

Connecting the initial section 19 of the new material web to the material web 14 which is running out is performed automatically. The outgoing reel 16 is run until it is completely empty. The end of the material web 14 is scanned. Provided on the present exemplary embodiment (FIG. 2) is a photocell 37 which observes the material web 14 which is running out. Instead of this, a circulating, contactless calliper, for example, an initiator can be configured in the region of a rotating bearing of the reel 16. After the material web 14 has run out, this calliper detects the lack of movement in the reel mounting or the reduced rotating speed as a signal for the complete run-off of the material web 14.

When the complete run-off of the material web 14 has been determined, the transfer process is initiated immediately. To this end the transfer lever 31 is swivelled in the described direction until it is in contact with the perimeter of the deflection roller 21. The swivel movement of the transfer roller 31 is effected by a control unit actuated by the photocell 37, namely by an (electro) cylinder 38, the piston rod 39 of which is connected to a transversely oriented arm 40 of the transfer lever 31.

On the present embodiment, the replacement reel 18 is prepared manually for being connected. The initial section 19 is drawn by hand from the replacement reel 18 and brought into the described position in contact with the transfer roller 30 and transfer lever 31. A stationary blade 41 is located below the transfer roller 30. An end of the initial section 19 is separated on this blade, such that the initial section is in contact with the transfer roller 30 always in an exact relative position. Moreover an exact end edge is created by the blade 41. The blade 41 is likewise attached to the carrying wall 22.

The device or the splicing station 17 is provided with monitoring members which monitor the presence of material, namely the material web 14, in the important regions. The embodied idea consists in the fact that, on the one hand the rotary movement of the deflection roller 21 presupposes the presence of the material web 14. On the other hand, however, the orderly drawing-off of the adhesive tape 10 can be monitored, namely in respect of its length. To this end, the rotary movement of the deflection roller 21 is monitored by contactless callipers, namely by a so-called initiator 64. The latter cooperates in a non-contact manner with a control member rotating with the deflection roller 21. In the present case, a control disc 65 is provided with (three) radial projections 66 disposed at equal peripheral spacings from one other, and is arranged on a shaft for the deflection roller 21, i.e. rotating with same. The initiator 64 is acted upon by the projections 66 of the rotating control disc 65. By this means, on the one hand the rotary movement of the deflection roller is basically recognized, but on the other hand so is the length of the drawn-off section of the material web 14.

Active reel 16 and replacement reel 18 have a predetermined relative position as a result of the operating manner of the splicing station 17. To this end, the reels 16, 18 are mounted so as to be adjustable, namely on a member which may be swivelled or rotated. In the present case, this is an (upright) carrying disc 42. The latter is rotably mounted with a central bearing 43 on the carrying wall 22. The carrying disc 42 is rotated after each reel change, in such a way that the replacement reel 18 moves into the position of the active reel 16. The carrying disc 42 is here rotated clockwise as per arrow 44. The material web 14 here moves out of the region of the replacement reel 18 until it is in contact with the shoe 23, the cross-section of the material web 14 being deformed as it enters the cavity of the shoe 23. On the present embodiment, the shoe 23 may be swivelled around the (lower) pivot bearing 24 into the position shown with a dot-dash line in FIG. 2. In this position, the rotation of the carrying disc 42 is carried out. The shoe 23 is then swivelled back into its working position and, in so doing, picks up the material web 14.

On this embodiment, the carrying disc 42 may be rotated by hand. Handles are provided for this purpose, one handle 45, 46 in the region of each reel bearing 47, 48. The handles 45, 46 projecting transversely can be grasped and thus the carrying disc 42 is turned.

The operating position of the carrying disc 42 is fixed by a snap-in pin which may likewise be actuated by a grip 49 and which enters a snap-in bore 50 of the carrying disc 42 to fix same to a holding device, namely to the carrying wall 22.

The handles 45, 46 in the region of the reel bearings 47, 48 have a dual function. Through springs 51, the handles exercise an axially directed pressure on the reels 16, 17 or on a reel core 52. By this means, a braking effect is generated as a result of friction in the region of the reels 16, 18. The braking effect may be set with the aid of knurling wheels 53 which can be adjusted to alter the tension of the springs 51.

A further special characteristic relates to the arrangement of the tape assemblies 12, 13. The device is attached overall to a portal-like carrying frame 54. The two splicing stations 17, arranged the one above the other, or the carrying wall 22 of same, are/is attached to an upright support 55 of the carrying frame 54. The two tape assemblies 12, 13 are mounted on a holding device 57 on an opposite support 56. The holding device has an upper and a lower carrying arm 58, 59, projecting transversely. One tape assembly 12, 13 is mounted on the end of each carrying arm. Each tape assembly 12, 13 may be displaced with a guide 60, 61 on the carrying arm 58, 59, such that each tape assembly 12, 13 can be positioned exactly in a horizontal direction.

In addition to this, one of the tape assemblies 12, 13 in the present case the upper tape assembly 12, may be adjusted in a vertical direction to adapt to different formats of folded cardboard boxes 11. The carrying arm 58 is connected to a vertical guide 62. The latter may be displaced in a vertical direction on an upright carrying rod 63. Said rod is part of the holding device 57.

We claim:

1. Device for connecting material webs (14), having at least one splicing station (17) in which an outgoing material web (14) is drawn from a reel (16) and in which a replacement reel (18) is held ready for connecting an initial section (19) of a new material web (14) to the outgoing material web (14), characterized by the following features:

a) the outgoing and the new material webs (14) are coated on one side with adhesive (15) for providing adhesive tapes (10) for folded cardboard boxes, b) the outgoing material web (14) runs along a guide over a deflection roller (21), in such a way that the adhesive (15) lies on a free outer side, c) the initial section (19) of the new material web (14) which is to be connected to the outgoing material web lies with its adhesive (15) side against a transfer member (30), d) the transfer member (30) is provided with projections in such a way that the initial section (19) lies with the adhesive side against the projections of the transfer member (30) with reduced retaining force, e) the initial section (19) of the new material web is being pressed with its non-adhesive side against the facing adhesive side (15) of the outgoing material web (14) on a deflection roller (21) by moving the transfer member (30) with the initial section (19) of the new material web.

2. Device according to claim 1, characterized in that the transfer member is a transfer roller, the perimeter of the transfer roller (30), is configured with points (34) disposed along the perimeter in contact with the adhesive (15) side of the initial section (19), the points (34) being formed by pyramid-shaped raised parts (35) arranged in longitudinal and transverse rows.

3. Device according to claim 2, characterized in that the transfer member for the initial section (19) consists of a rotatable transfer roller (30) arranged on a swivellable carrying means, against which the initial section (19) lies in a partial region of the perimeter, and in that, to transfer the initial section (19), the transfer roller (30) may be pressed against the outgoing material web (14), the region of the deflection roller (21) for the material web (14).

4. Device according to claim 1, characterized in that the transfer member for the initial section (19) has a swivellable transfer lever (31), on the end of which the transfer roller (30) is arranged, and in that the transfer lever (31) may be swiveled by an actuating cylinder (38).

5. Device according to claim 1, characterized in that, in front of the deflection roller (21) for the material web (14), in the conveying direction, there is arranged a guide member, being an elongated rectilinear shoe (23) with a profiled guide surface (25) for the outgoing material web (14), in such a way that the outgoing material web (14) has an arcuate cross-sectional shape in the region of the shoe (23) preceding the deflection roller (21).

6. Device according to claim 1, characterized in that the reel (16) and the replacement reel (18) are disposed on a common movable carrying means being a rotatable carrying disc (42), the carrying disc (42) being rotatable once the initial section (19) of a new material web has been connected to the outgoing material web (14), in such a way that the (previous) replacement reel (14) moves into the position of the active reel (16).

7. Device according to claim 1, characterized in that, in order to supply two assemblies (12, 13) for adhesive tape (10), two independent, matching splicing stations (17) are provided, arranged as a mirror image in relation to a horizontal plane.

8. Device according to claim 1, characterized in that a plurality of tape assemblies (12, 13) for adhesive tape (10) are disposed on a holding device (57) in such a way that each one of said tape assemblies (12, 13) may be adjusted in a horizontal direction and at least one tape assembly (12) may be adjusted in a vertical direction.

9. Device according to claim 1, characterized in that the transfer member for the initial section (19) consists of a rotatable transfer roller (30) arranged on a swivellable carrying means, against which the initial section (19) lies in a partial region of the perimeter, and in that, to transfer the initial section (19), the transfer roller (30) may be pressed against the outgoing material web (14), in the region of the deflection roller (21) for the material web (14).

10. Method for connecting outgoing and new material webs (14), the outgoing material web (14) being drawn from a first reel (16) and, once this has been used up, a new material web on a replacement reel (18) is connected to the outgoing material web (14) which is running out, characterized by the following steps:

a) providing the outgoing and new material webs (14) to be connected with adhesive coating on one side, b) holding an initial section (19) of the new material web to be connected by a transfer member consisting of a transfer roller (30) at the end of a transfer lever (31), c) maintaining the initial section (19) of the new material web with the side exhibiting the adhesive (15) against said transfer member (30, 31), d) holding the initial section (19) of the new material web against the transfer roller (30) and transfer lever (31) with reduced retaining force, e) connecting the initial section (19) with the outgoing material web (14) by pressing the non-adhesive side of the new material web against the facing adhesive (15) side of the outgoing material web (14), such that, due to the reduced retaining force, the outgoing material web (14) which is running out detaches the initial section (19) of the new material web from the transfer member and carries it along.

11. Method according to claim 10, characterized in that the outgoing material web (14) is completely drawn from the reel (16) or a reel core (52), at least an end section of the outgoing material web (14) drawn from the reel (16) is deformed in its cross-section during transport, forming an open hollow profile, having a trough-like transverse deformation, and is then connected with the initial section (19) of the new material web.

* * * * *

UNITED STATES PATENT AND TRADEMARK OFFICE

CERTIFICATE OF CORRECTION

PATENT NO. : 6,082,661
DATED : July 4, 2000
INVENTOR(S) : Heinz Focke, Verden hugo Mutshall It is certified that error appears in the above-identified patent and that said Letters Patent is hereby corrected as shown below:

Title page,
After Item [22], insert the following:
-- [30] Foreign Application Priority Data
July 18, 1997 (DE) 19731024.9 --

Signed and Sealed this

Twenty-second Day of January, 2002

*Attest:*

*Attesting Officer*

JAMES E. ROGAN
*Director of the United States Patent and Trademark Office*